United States Patent [19]

Uselton et al.

[11] 4,320,630

[45] Mar. 23, 1982

[54] HEAT PUMP WATER HEATER

[75] Inventors: Robert B. Uselton; Joseph A. Pietsch, both of Dallas, Tex.

[73] Assignee: Atlantic Richfield Company, Los Angeles, Calif.

[21] Appl. No.: 204,497

[22] Filed: Nov. 6, 1980

[51] Int. Cl.[3] ..... F25B 27/02

[52] U.S. Cl. ..... 62/238.6

[58] Field of Search ..... 62/238.6

[56] References Cited

U.S. PATENT DOCUMENTS

| | | | |
|---|---|---|---|
| 2,516,094 | 7/1950 | Ruff | 62/238.6 X |
| 2,668,420 | 2/1954 | Hammell | 62/238.6 X |
| 2,716,866 | 9/1955 | Silva | 62/238.6 X |
| 2,802,342 | 8/1957 | Gray | 62/238.6 X |
| 4,055,055 | 10/1977 | Horwitz | 62/238.6 |
| 4,091,994 | 5/1978 | Madsen | 62/238.6 X |
| 4,148,355 | 4/1979 | Gehring | 62/238.6 X |
| 4,173,872 | 11/1979 | Amthor, Jr. | 62/238.6 |

*Primary Examiner*—Lloyd L. King

*Attorney, Agent, or Firm*—James C. Fails

[57] ABSTRACT

What is disclosed is an improvement in a heat pump water heater wherein the elements are disposed in a thermoplastic, molded base atop the hot water storage tank. The molded base has a drain for draining off liquid condensate. The condenser is in the form of a coil having the respective refrigerant and water paths for flowing in heat exchange relationship and disposed atop the hot water storage tank. The water has its own respective pump for being circulated through the condenser for heating the water while condensing the refrigerant. The evaporator is disposed peripherally around the top of the hot water storage tank so that the air that vaporizes the refrigerant is cooled and can be vented back to the air conditioned space. A self-supporting air filter is provided.

4 Claims, 5 Drawing Figures

HEAT PUMP WATER HEATER

FIELD OF THE INVENTION

This invention relates to a heat pump device for heating water for hot consumption water and referred to as "heat pump water heater".

DESCRIPTION OF THE PRIOR ART

A wide variety of ways for heating water have been developed, the water being used interiorly of buildings; such as a home, cafe or other small business and the like. As is recognized, most of the early water heaters required production of heat by electrical resistance heating, by gas, by other combustibles, such as coal, fuel oil or the like. With increasing scarcity of energy, more efficient ways of heating are being looked at. For example, early in the twentieth century it was recognized that heat pumps could be employed to merely pump heat around rather than having to create the heat. Consequently, their coefficient of performance exceeded one; ordinarily, about 2–3. With today's more efficient heat pumps, the coefficient of performance can be increased even more. Illustrative of the types of prior art approaches to employing heat pumps to heat water are those described in the following U.S. Pat. Nos.: 2,095,017; 2,516,094; 2,575,325; 2,690,649; 2,632,306; 2,751,761; 2,716,866; 4,091,994; 4,098,092; 4,103,509; 4,134,274; 4,141,222; 4,142,379 and 4,173,872. This prior art has disclosed a wide variety of attempts to improve the efficiency of the heat pump by varying capacity, employing the superheat from the compressed refrigerant, by immersing the refrigerant coil in the hot water storage tank or by employing it as a part of a larger system including a hot water circulation and radiator heating system. The systems have been disadvantageous in employing complex instrumentation with a plurality of units located at different locations and have not fully taken advantage of the ability to simultaneously heat the water and cool the air for being used interiorly of the building for air conditioning during a hot summer or the like. Specifically, the prior art has failed to provide a compact unit that is self contained with the elements of the heat pump readily serviceable; yet, providing the advantage of both heating the water and cooling the ambient air within the building. Moreover, the prior art failed to provide the positive circulation of the water in heat exchange relationship with the refrigerant for greater efficiency of the exchange of heat between the hot compressed refrigerant gas and the water.

SUMMARY OF THE INVENTION

Accordingly, it is an object of this invention to provide a heat pump water heater that is compact and self-contained but having the elements of the heat pump readily serviceable; yet, providing simultaneous heating of the water and cooling of the air for air conditioning the interior of the building.

It is a further object of this invention to provide a heat pump water heater satisfying the above objective and also providing positive water circulation for more efficient transfer of heat between the hot compressed refrigerant gas and the water.

These and other objects will become apparent from the descriptive matter hereinafter, particularly when taken in conjunction with the appended drawings.

In accordance with this invention there is provided an improvement in a heat pump water heater adapted for use in a building such as a home and the like and having a hot water storage tank along with a compressor, a condenser, an evaporator and a thermostatic expansion valve connected in a closed circuit containing a refrigerant and adapted to circulate hot refrigerant gas in heat exchange relationship with the water for heating the water. The improvement is characterized by a thermoplastic, molded base disposed on top of the hot water storage tank, the molded base having disposed interiorly and adjacent its periphery an evaporator receiving depression that has a drain for draining off water condensate. The improvement also includes mounts for the compressor atop the hot water storage tank, having the condenser in the form of a coil having a refrigerant path and a water path for transferring heat from the hot compressed refrigerant gas to the water efficiently with the water being circulated by a water pump in a water circuit from interiorly of the hot water storage tank through the condensor water path and back into the hot water storage tank. The improvement further has an evaporator in the form of a heat exchange coil disposed upright on top of the hot water storage tank disposed adjacent the periphery in the depression and drain of the molded base with a top defining an air circulation path for flowing ambient air from inside the air conditioned space to the building in heat exchange relationship with the evaporator for vaporizing a condensed liquid therewithin; and an air circulation means for circulating the ambient air from within the building in heat exchange relationship with the refrigerant in the evaporator, simultaneously evaporating the refrigerant and cooling the air and a means for discharging the cooled air into the interior of the building for cooling the building simultaneously with the heating of the water. The water circulation pump has its suction line extending to the bottom of the hot water storage tank. The evaporator has a generally circular configuration and has a self-supporting air filter with a plurality of semi-circular pieces disposed peripherally exteriorly of the evaporator which is located on top of the hot water storage tank.

DESCRIPTION OF THE PREFERRED EMBODIMENTS

Figure 1:
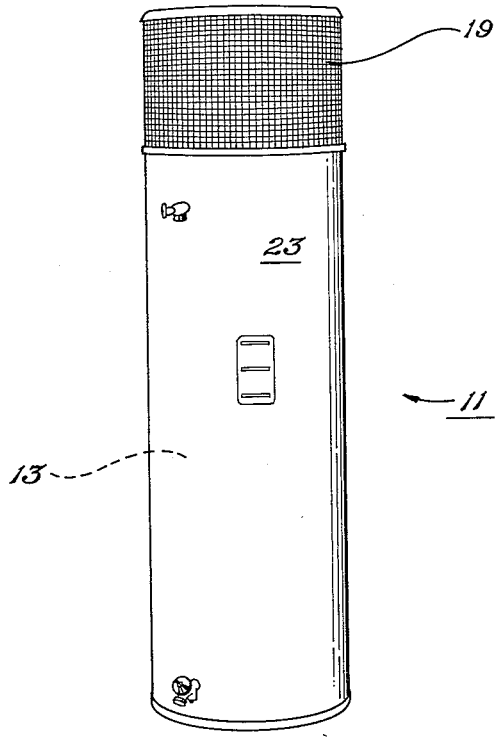
FIG. 1 is a perspective view of one embodiment of the heat pump water heater in accordance with this invention.
Figure 2:
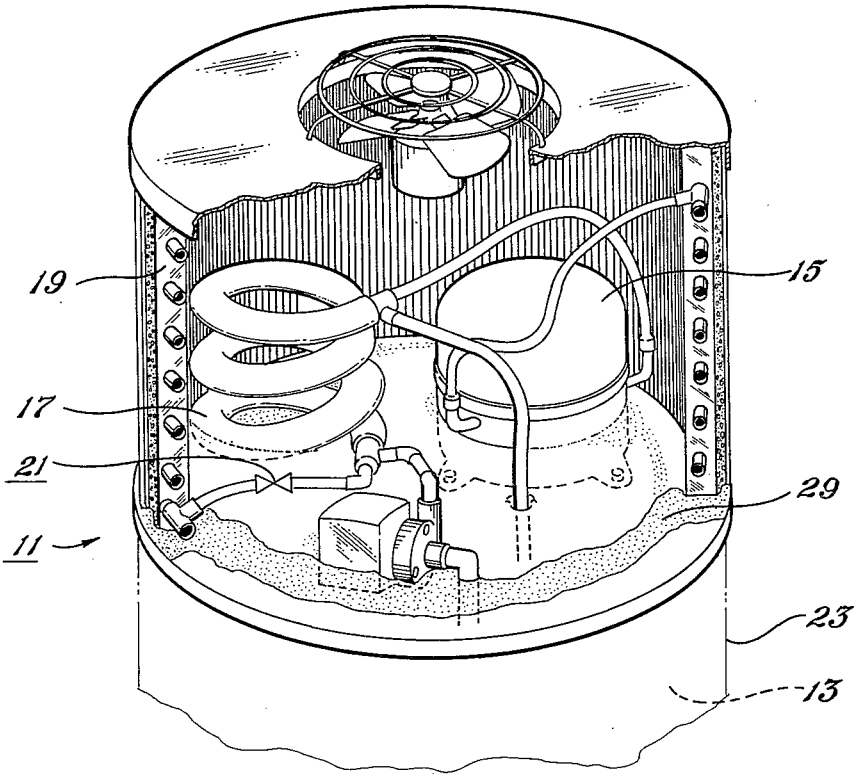
FIG. 2 is a partial perspective view from the top showing the elements of the heat pump with a portion of the evaporator and top cut away for clarity.
Figure 4:
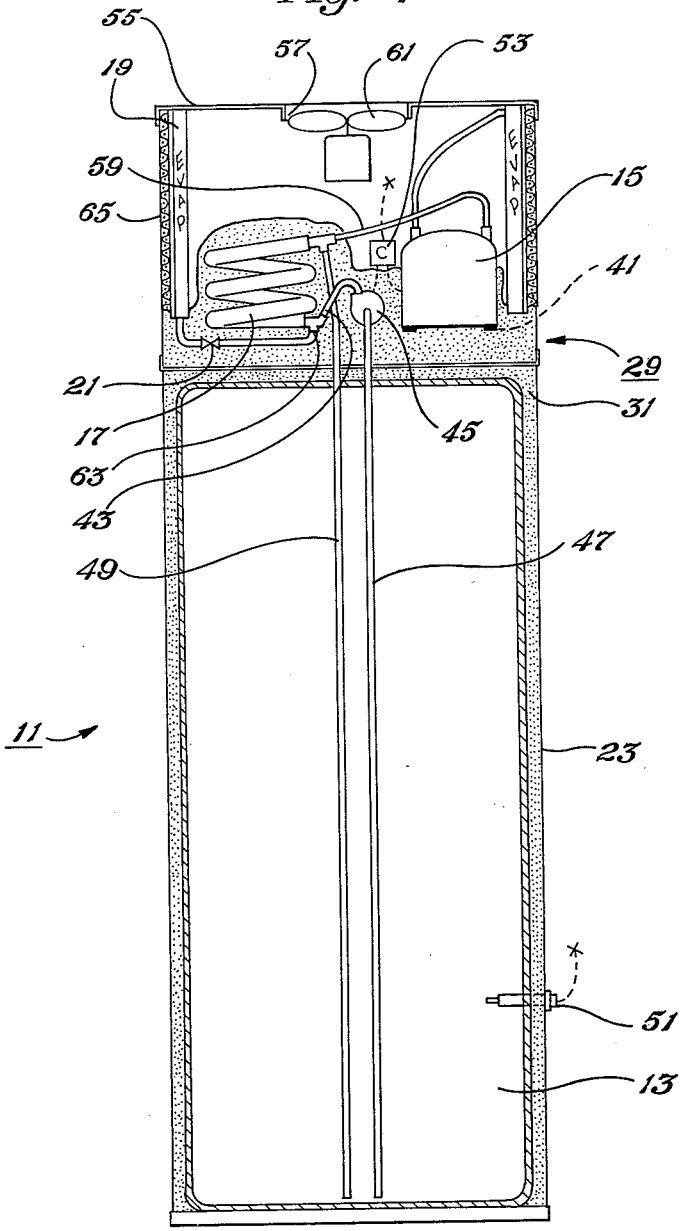
FIG. 4 is a cross sectional view, partly schematic, of the embodiment of FIG. 1.

Referring to the FIGS. and particularly FIGS. 1, 2 and 4, the heat pump water heater 11 includes a compressor 15, FIGS. 2 and 4, a condenser 17, an evaporator 19 and a thermostatic expansion valve 21; all connected in a closed circuit containing a refrigerant and adapted to circulate hot refrigerant gas in heat exchange relationship with the water for heating the water which is circulated from a hot water storage tank 13.

The hot water storage tank 13 may comprise any of the conventional vessels. For example, the storage tank may comprise a steel tank that is lined with some non-corrosive interior such as copper, glass or the like. Ordinarily, the hot water storage tank is surrounded by insulation and disposed interiorly of a decorative cabinet 23, FIGS. 1 and 2. The hot water storage tank and cabinet may be cylindrically shaped although any other shape may be employed as desired depending upon the nature of the installation.

The compressor 15 may comprise any of the types of compressors ordinarily employed. Preferably, it comprises a rotary compressor to take advantage of the lower power consumption that can be effected with a low pressure ratio; such as, disclosed in a co-pending application Ser. No. 06/050,548; Amir L. Ecker, inventor, entitled "Heat Pump Employing Optimal Refrigerant Compressor For Low Pressure Ratio Applications"; assigned to the assignee of this invention. The details of application Ser. No. 06/050,548 are incorporated herein by reference for details that are omitted herefrom. Such a low pressure ratio can be effected with a heat pump for heating water and circulating ambient air within a building, where the air is about 70°–80° F. (24°–28° C.). As is recognized these rotary compressors may comprise either the rolling piston rotary compressors or the rotating vane rotary compressors.

The condenser 17 may comprise any of the conventional condensers that provide both a water path and a refrigerant path for heat exchanging between the hot compressed refrigerant gas and the water. One of the improvements of this invention, however, is having the condenser in the form of a coil having both refrigerant and water paths for heat exchange between the hot compressed refrigerant gas and the water; the coil being small and readily emplaced atop the hot water storage tank 13.

The evaporator 19 may ordinarily comprise any conventional air-to-refrigerant evaporator for vaporizing the liquid refrigerant condensed in the condenser. The vaporizing is done, for example, by circulation of an ambient fluid such as warm air in heat exchange relationship with the condensed liquid refrigerant while simultaneously lowering the pressure on the refrigerant to allow it to vaporize. The lowering of the pressure is done, as is well recognized, by suction of the compressor reducing the pressure in the evaporator while the thermostatic expansion valve 21 restricts the flow of liquid refrigerant into the evaporator. One of the improvements of this invention comprises having the evaporator in the form of a heat exchange coil disposed upright on top of the hot water storage tank and disposed adjacent the periphery thereof and disposed in a depression having a drain in a molded base that is described in more detail hereinafter. The upright evaporator is in the form of a generally circular element such that the ambient air from interiorly of the building is circulated past the evaporator.

The thermostatic expansion valve may comprise any of the conventional expansion valves conventionally employed with heat pumps. The thermostatic expansion valve may be responsive to temperature or pressure in the suction line to the compressor and restricts the flow of liquid refrigerant to insure that no liquid flows into the compressor 15.

Figure 3:
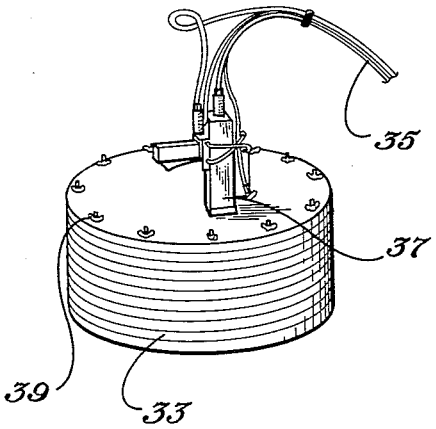
FIG. 3 is an isometric view of an injection mold for molding the plastic base that sits atop the heat pump water heater of FIG. 1 and holding the elements of the heat pump atop the hot water storage tank.

In accordance with this invention the heat pump water heater also includes a thermoplastic molded base 29. FIGS. 2 and 4, disposed on top of the hot water storage tank, either directly or on top of the exterior cabinet 23. Ordinarily it is preferable to allow insulation 31 to be emplaced about the hot water storage tank and interiorly of the cabinet 23. This protects the thermoplastic base from the heat of the hot water interiorly of the hot water storage tank 13. The base 29 is formed by injection of a foamed thermoplastic material, such as polyethylene, polystyrene, polyurethane or the like, interiorly of a mold 33, FIG. 3. The injection is carried out by way of convention injectors through high pressure tubing 35 and a conventional valving 37. Once the mold is set, the fastening means 39, such as bolt nuts are released and the mold divided. The resulting molded base 29 is then taken from the mold and emplaced atop the water heater cabinet 23. As indicated, the mold can be emplaced directly atop the hot water storage tank 13 if desired. The molded base has disposed interiorly and adjacent its periphery an evaporator receiving depression that has a drain for draining off condensed liquids, such as water condensed from the ambient air in the building. The drain is ordinarily connected exteriorly of the building or into the sewer line. Of course, suitable traps are employed if it is connected into the sewer line to prevent entry of noxious and dangerous gases from the sewer line into the interior of the building.

Respective mounts 41 may be employed for the compressor. Frequently such mounts are integral with the hermetically sealed compressor units and can sit in a depression designed for the compressor and formed into the molded base 29. The usual adjustable vibration-allowing bolts may be employed for holding the compressor during shipment and the life if desired.

As indicated hereinbefore, the condenser has a water path. The water path is connected, as by conduit 43, with a water circulation means in the form of pump 45 for circulating the water through the water path of the condenser for picking up heat from the hot compressed refrigerant gas. The pump 45 is powered by a conventional electric motor and has it suction line 47 extending to the bottom of the hot water storage tank 13 for picking up the least-hot water when it is desired to turn on the pump and heat pump to circulate and heat the water. Ordinarily the pump 45 comprises a small centrifugal pump that has very little power consumption. The pump 45 will be sized to afford the circulation rate desired for the particular hot water heater and may range from a low of only a few gallons per minute; for example 1–3 gallons per minute; to as high as many gallons per minute for large commercial units; for example, 10–20 gallons per minute. The discharge line 49 is connected with the discharge of the water path of the condenser 17 and interiorly of the hot water storage tank 13. The discharge line 49 extends to the bottom of the tank as illustrated in FIG. 4 to maintain better thermal stratification.

The signal to circulate the water may be provided by any of the conventional instrumentation. As illustrated, a thermocouple 51 is shown in a thermocouple well penetrating interiorly of the hot water storage tank and connected, as shown by the line noted "x" with a controller 53 that is connected with the compressor and the pump to start the heating when the water temperature is low enough to warrant such action. Similarly, when the water temperature becomes hot enough the pump and compressor are de-energized by a signal from the controller 53. Any other form of instrumentation that will enable monitoring the temperature of the water can be employed in accordance with this invention. It is sufficient to note that the instrumentation should commence the heating by circulating the water and the hot refrigerant gas when the water interiorly of the hot water storage tank 13 becomes cold enough and stop the heat exchange when the water becomes hot enough. For example, the water temperature may be controlled within the range of 110° F. (49° C.) to 180° F. (81° C.). Ordinarily, the temperature will be controlled at about 130° F. (54° C.) ±5° F. It is noteworthy that the water circuit is connected serially with the path in the condenser and has both suction and discharge lines communicating interiorly of the hot water storage tank.

The heat pump water heater 11 has a top 55 that fits over the evaporator and defines an air circulation path for flowing ambient air from the interior of the air conditioned space of the building in heat exchange relationship with the evaporator for vaporizing a refrigerant therewithin. Specifically, the top has an aperture 57 for discharging cold air resulting from having circulated warm air past the evaporator 19. Since the air is cooled, it is preferred that the discharge conduit 59 from the compressor be insulated to prevent loss of heat to the air and result in more effective heating of the water interiorly of the condenser 21. Preferably the condenser 21 is also insulated as are the respective hot water circulation lines (for the same reason).

An air circulation means in the form of the powered fan 61 effects circulation of the ambient air and directs it to an appropriate location. The cold air is circulated interiorly of the building to cool the interior of the building and help reduce the heat load on any air conditioning equipment that may be cooling the building. The fan 61 may comprise any of the conventional types of fans including bladed fans, squirrel cage fans or the like. Ordinarily they are powered by small electric motors.

Figure 5:
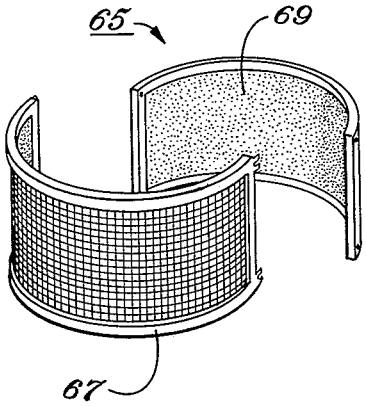
FIG. 5 is a perspective view of the semi-circular filters disposed exteriorly of the evaporator in the embodiment of FIG. 4.

Air filters 65 are provided. As can be seen in FIG. 5, the filters 65 are provided in a plurality of pieces; such as, a pair of pieces; to encompass the evaporator and prevent its coils being plugged from dust, lint, and the like in the warm ambient air interiorly of the building. The filter 65 comprises an aluminum frame 67 with expanded metal protector and a thin foam element 69 that forms the filter media. Each illustrated filter 65 is rolled to semi-circular form and the halves attached to the heat pump housing intermediate the top 55 and the base 29, as by snap in connectors.

In operation, the water interiorly of the hot water storage tank will be reduced in temperature, either by heat loss through the tank walls or by incoming cold water. While the incoming cold water conduits and effluent hot water conduits are not shown in FIG. 4, it is understood that they are connected in a conventional hot water usage system, which is not shown also for simplicity of illustration. In accordance with the usual practice, the inlet conduit is terminated near the bottom of the hot water storage tank 13 while the effluent hot water conduit takes it suction near the top of the hot water storage tank to get the hottest water and take advantage of thermal strafication and the time of residence to allow heating of the incoming cold water and prolong the usefulness of the stored hot water. When the thermostat 51 indicates that the water is not warm enough, the controller 53 picks up the low temperature signal and turns on the compressor 15 and the pump 45. Water is circulated through the condenser 17 simultaneously and, preferably, in counter current flow with the hot refrigerant gases coming in through conduit 59 from the compressor 15. The heated water is returned through conduit 49 to the hot water storage tank 13.

The condensed refrigerant liquid is sent via conduit 63 and the thermostatic control valve 21 to the evaporator 19 where it is evaporated by warm air being pulled in over the evaporator.

The warm air is passed through the filters 65. The air is cooled and circulated by the fan 61 out into the ambient interiorly of the building.

From the foregoing it can be seen that this invention provides the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appended claims.

We claim:

1. In a heat pump water heater adapted for use in a building such as a house and the like, and including a. a compressor;

b. a condenser;

c. an evaporator; and d. an expansion device; connected in a closed circuit containing a refrigerant adapted to circulate hot refrigerant gas in heat exchange relationship with water for heating said water; and e. a hot water storage tank and water circuit connected and adapted for circulation of said water in heat exchange relationship with said hot refrigerant; the improvement comprising:

f. a thermoplastic, molded base disposed on top of said hot water storage tank; said molded base having disposed interiorly and adjacent it periphery an evaporator receiving depression that has a drain for draining off condensed liquid;

g. respective mounts for said compressor;

h. having said condenser in the form of a coil disposed atop said hot water storage tank on said base and having a refrigerant path and a water path for transferring heat from hot, compressed, refrigerant gas to said water, simultaneously condensing said refrigerant to a liquid refrigerant;

i. water circulating means for circulating said water through said water path of said condenser;

j. water circuit connected serially with said water path in said condenser and having suction side of said water circulating means communicating interiorly of said hot water storage tank and having discharge line from said water path and said water circulating means connected interiorly of said hot water storage tank;

k. having said evaporator in the form of a heat exchange coil disposed upright on top of said hot water storage tank and disposed adjacent said periphery and in said depression, with drain, of said molded base;

l. a top defining an air circulation path for flowing ambient air in heat exchange relationship with said evaporator for vaporizing said liquid refrigerant within;

m. air circulation means for circulating said ambient air in heat exchange relationship with said evaporator, simultaneously evaporating said refrigerant and cooling said air; and n. means for circulating the cooled air into the interior of said building for cooling said building simultaneously with heating said water.

2. The water heater of claim 1 wherein said water circulation means comprises a pump with a suction line extending to the bottom of said hot water storage tank.

3. The water heater of claim 2 wherein said pump has a discharge line that also extends to the bottom of said hot water storage tank.

4. The water heater of claims 1, 2, or 3 wherein said evaporator has a circular configuration and has respective plurality of circularly shaped, self supporting, air filter elements disposed peripherally exteriorly thereof on top of said hot water storage tank.

* * * * *